US006450623B1

(12) United States Patent
Watanabe et al.

(10) Patent No.: US 6,450,623 B1
(45) Date of Patent: Sep. 17, 2002

(54) INKJET HEAD WHICH ARRANGES PROTECTIVE LAYER AT SURFACE TO WHICH NOZZLE PLATE IS CONNECTED AND METHOD FOR MANUFACTURING THE INKJET HEAD

(75) Inventors: Mutsuo Watanabe, Zama; Masayuki Sasaki, Kawasaki; Kouichi Sanpei, Sagamihara; Mitsuhiro Soneda, Ebina, all of (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/256,085

(22) Filed: Feb. 24, 1999

(30) Foreign Application Priority Data

Feb. 26, 1998 (JP) ..... 10-045810

(51) Int. Cl.[7] ..... B41J 2/045

(52) U.S. Cl. ..... 347/68; 347/69; 347/70; 347/71

(58) Field of Search ..... 347/68–72

(56) References Cited

U.S. PATENT DOCUMENTS 5,424,769 A * 6/1995 Sakai et al. ..... 347/70
5,680,163 A * 10/1997 Sugahara ..... 347/71
5,912,526 A * 6/1999 Okawa et al. ..... 347/71

* cited by examiner

*Primary Examiner*—John Barlow
*Assistant Examiner*—An H. Do
(74) *Attorney, Agent, or Firm*—Armstrong, Westerman & Hattori, LLP

(57) ABSTRACT

The present invention has an object to provide an inkjet head and a method for manufacturing the inkjet head which not only protects a member at and/or near a surface onto which the nozzle plate is connected (nozzle connection surface), but also shortens the manufacturing time. A protective layer is provided between the nozzle plate and the piezo-electric element, enabling only the protective layer to be polished, protecting the piezo-electric element from being damaged by the polishing when the nozzle connection surface is formed. After the inkjet head is completed, the protective layer prevents ink leakage to the piezo-electric element.

10 Claims, 7 Drawing Sheets

INKJET HEAD WHICH ARRANGES PROTECTIVE LAYER AT SURFACE TO WHICH NOZZLE PLATE IS CONNECTED AND METHOD FOR MANUFACTURING THE INKJET HEAD

BACKGROUND OF THE INVENTION

The present invention relates generally to fluid pumps which controllably send a very small amount of fluid from a nozzle hole in a nozzle plate, and more particularly to a fluid pump which is manufactured by adhering the nozzle plate to a chamber which accommodates and ejects fluid.

The fluid pump of the present invention is especially suitable for heads of inkjet printers (i.e., inkjet heads), which are universally used as general printers, or copiers, facsimile machines, computer systems, and word processors, and a combination thereof that have a printing function.

Structurally speaking, among inkjet printers, some are manufactured by adhering a nozzle plate having a nozzle hole through which ink is sent, to a chamber that accommodates ink. Some inkjet heads using a piezo-electric element, for example, have recently become more and more popular due to its good energy efficiency. The inkjet heads of this type adhere a nozzle plate to a pressure chamber, and jet ink by raising pressure in the pressure chamber using deformation of the piezo-electric element.

The above inkjet head typically is made by connecting a nozzle plate to a three-layer structure including a pressure-chamber plate having a pressure chamber, a thin plate, and a piezo-electric element. The pressure chamber is formed by a concave groove in the pressure-chamber plate and the thin plate. The piezo-electric element is arranged opposite to the pressure chamber on the thin plate.

The piezo-electric element has internal and external electrodes. When voltage is applied from the external electrode to the internal electrode, i.e., when the piezo-electric element is charged, it deforms so that it can compress the pressure chamber via the thin plate, and returns to the original state as a result of removal of the voltage (or discharge). The thin film transmits the deformation of the piezo-electric element to the pressure chamber. Thus, voltage application from the external electrode to the internal electrode deforms the piezo-electric element and compresses the pressure chamber via the thin film, whereby ink is ejected from the pressure chamber through the nozzle hole. Recently, in order to achieve high resolution images by narrowing a pitch between adjacent nozzle holes, a piezo-electric element that has a layered structure and is divided into a plurality of parts has been increasingly utilized.

The realization of high-resolution images requires not only narrowing a adjacent-nozzle-hole pitch but also precisely jetting ink from a nozzle hole in a predetermined direction. In addition, the nozzle plate should be firmly secured to the three-layer structure. However, it is difficult to adhere the three layers to one another and form the three-layer structure so that the three layers are aligned with a nozzle connection surface that is a surface to which the nozzle plate is connected. Accordingly, the conventional art polish the edge of the three-layer structure before the nozzle plate is connected to the three-layer structure, to form a flat nozzle connection surface.

Part of the external electrode of the piezo-electric element is cut off by the polishing process, and thus reconstructed at the nozzle connection surface by a vacuum evaporation. Then, the adhesive agent is applied, and the nozzle plate is adhered to the nozzle connection surface while the nozzle hole is aligned with the nozzle hole. The inkjet head is completed in this way. After the inkjet head is completed, ink is filled up in the pressure chamber.

It is thus necessary to polish and smooth the nozzle connection surface in manufacturing such a fluid pump that adheres the nozzle plate to the chamber which accommodates fluid. Nevertheless, the conventional manufacturing method is disadvantageous because the polishing process breaks mechanically or electrically a member at and/or near the nozzle connection surface, or requires an arduous reconstruction.

For instance, in the above inkjet head, the piezo-electric element is generally fragile, in particular, the piezoelectric element which has a layered structure easily suffers from exfoliation, crack, and chip-off as a result of polishing at the nozzle connection surface. In addition, a polishing speed which should set to be slow so as to minimize breaking of the piezoelectric element through polishing delays the manufacturing time.

Moreover, the external electrode of the piezoelectric element should formed before the polishing to inspect a characteristic (or yield) of the piezoelectric element and adhere the piezoelectric element that passes the inspection to the thin plate. However, it is cut off by the polishing, and reconstructed inconveniently after the polishing.

On the other hand, a fluid pump which adheres a nozzle plate to a fluid chamber has a disadvantage in that ink leaks from the nozzle connection surface due to bad adhesion of the nozzle plate or cracks of adhesive agent applied onto the nozzle connection surface.

For example, in the above inkjet head, the internal electrode tends to short-circuit since ink penetrates into the inside when ink is filled up in the pressure chamber or in another condition. This problem is particularly remarkable where the piezo-electric element is divided by grooves.

BRIEF SUMMARY OF THE INVENTION

Accordingly, it is a general object of the present invention to provide a novel and useful fluid pump and a method of manufacturing the pump in which the above disadvantages are eliminated.

Another and more specific object of the present invention is to provide a fluid pump and a method of manufacturing the pump which not only protect a member in the neighborhood of the nozzle connection surface but also shorten the manufacturing time.

In order to achieve the above object, an inkjet head of the present invention comprises a pressure-chamber plate which forms a pressure chamber for accommodating ink, a piezo-electric element which may compress the pressure chamber in the pressure-chamber plate, a protective layer, connected to the piezo-electric element, which protective layer forms at least part of a nozzle connection surface and spaces the piezo-electric element from the nozzle connection surface, and a nozzle plate having a nozzle hole which jets the ink in the pressure chamber when the piezo-electric element compresses the pressure chamber, the nozzle plate being connected to the nozzle connection surface.

Another inkjet head of the present invention comprises a piezo-electric element which forms a pressure chamber for accommodating ink, and may compress the pressure chamber, a protective layer, connected to the piezo-electric element, which protective layer forms at least part of a nozzle connection surface and spaces the piezo-electric element from the nozzle connection surface, and a nozzle plate having anozzle hole which jets the ink in the pressure chamber when the piezo-electric element compresses the pressure chamber, the nozzle plate being connected to the nozzle connection surface.

Another inkjet head of the present invention comprises a piezo-electric element which forms a pressure chamber for accommodating ink, and may compress the pressure chamber, the piezo-electric element having first and second internal electrodes, a protective layer, connected to the piezo-electric element, which protective layer shields the second internal electrode from the first internal electrode, and forms at least part of a nozzle connection surface, and a nozzle plate having a nozzle hole which jets the ink in the pressure chamber when the first and second internal electrodes are electrified and a potential difference occurs between the electrodes, enabling the piezo-electric element to compress the pressure chamber, the nozzle plate being connected to the nozzle connection surface.

Another inkjet head of the present invention comprises a pressure-chamber plate which forms a pressure chamber for accommodating ink, and forms at least part of a nozzle connection plate, a piezo-electric element, spaced from the nozzle connection surface, which may compress the pressure chamber in the pressure-chamber plate, and a nozzle plate having a nozzle hole which jets the ink in the pressure chamber when the piezo-electric element compresses the pressure chamber, the nozzle plate being connected to the nozzle connection surface.

A method of manufacturing an inkjet head of the present invention comprises the steps of adhering to one another a pressure-chamber plate which forms a pressure chamber for accommodating ink, a thin film, and a piezo-electric element which may compress the pressure chamber of the pressure-chamber via the thin film, forming a protective layer at least onto the piezo-electric element, polishing the protective layer and forming a nozzle connection surface at least onto the protective layer, and connecting to the nozzle connection surface a nozzle plate which has a nozzle hole which jets the ink in the pressure chamber when the piezo-electric element compresses the pressure chamber.

A fluid pump of the present invention comprises a first member which accommodates fluid, a second member, connected to the first member, which ejects the fluid accommodated in the first member, a protective layer, connected to the second member, which protective layer forms at least part of a nozzle connection surface and spaces the second member from the nozzle connection surface, and a nozzle plate having a nozzle hole which jets the fluid from the second member, the nozzle plate being connected to the nozzle connection plate.

Thus, the inkjet head of the present invention spaces the piezo-electric element from the nozzle connection surface by the protective layer, and thus does not suffer from ink leakage and other damages. In addition, according to the method of manufacturing the inkjet head, the protective layer protects the piezo-electric element from being broken by polishing.

Other objects and further features of the present invention will become readily apparent from the following description and accompanying drawings.

DETAILED DESCRIPTION OF PREFERRED EMBODIMENTS

Figure 1:
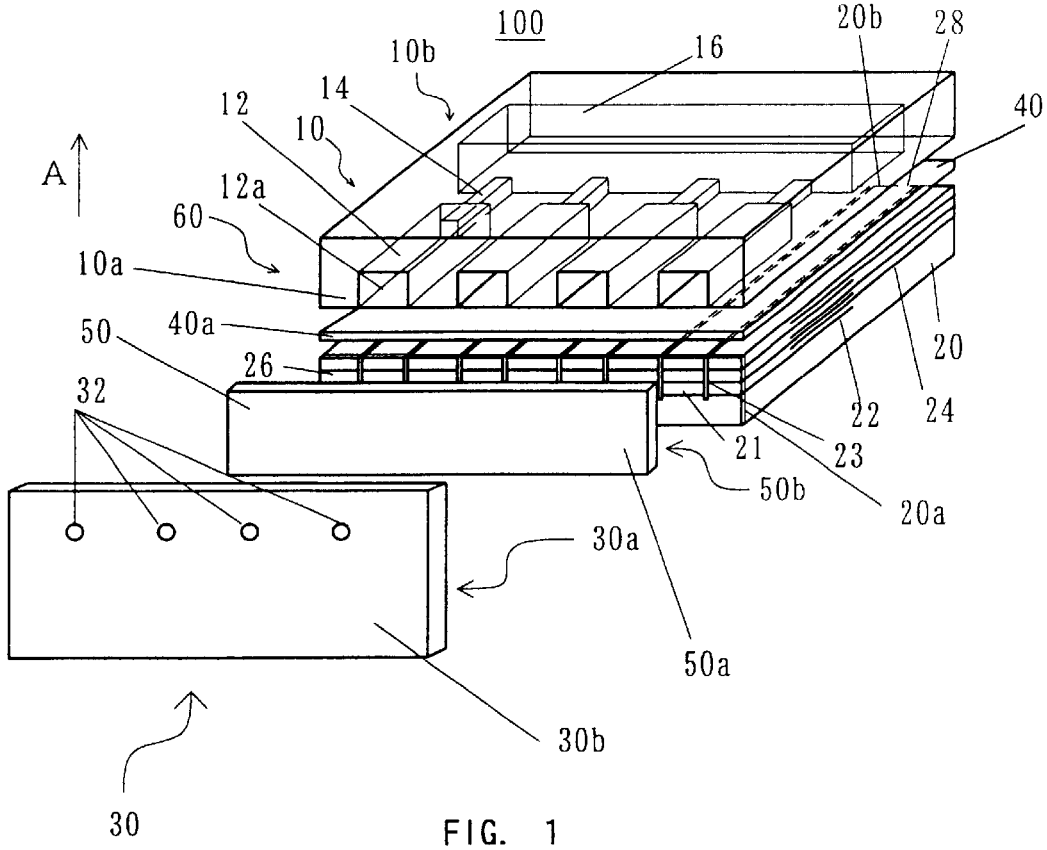
FIG. 1 is an exploded perspective view of an inkjet head of a first embodiment according to the present invention.
Figure 2:
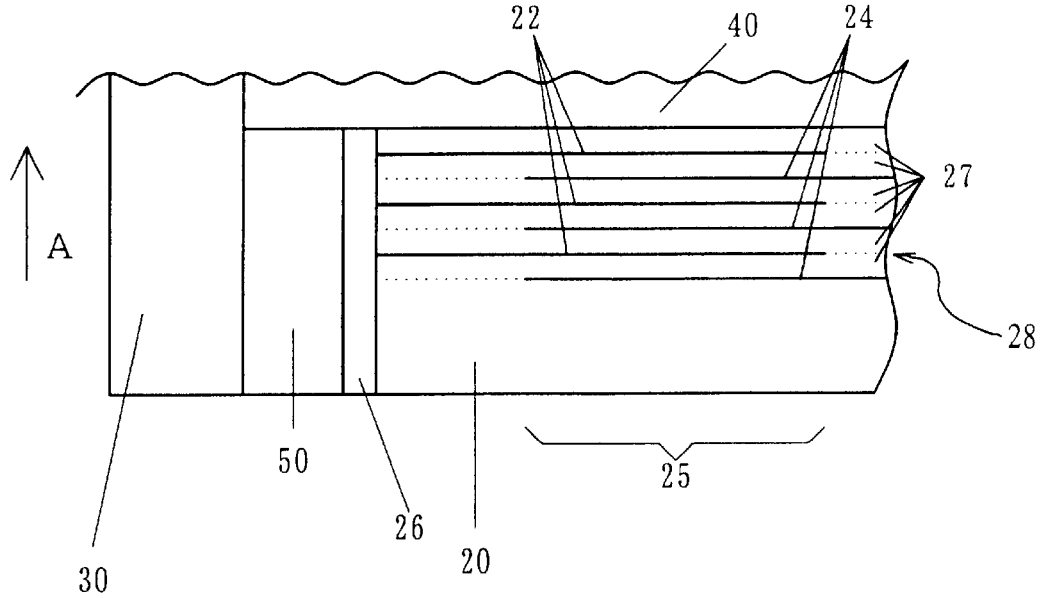
FIG. 2 is a partially enlarged side view of the inkjet head shown in FIG. 1.

Referring to FIGS. 1–7, a description will now be given of inkjet head 100 of a first embodiment according to the present invention. FIG. 1 is an exploded perspective view of the completed inkjet head 100, and FIG. 2 is a partially enlarged side view of the inkjet head 100 shown in FIG. 1. As shown in FIG. 1, the inkjet head 100 of the present invention includes pressure-chamber plate 10, piezo-electric element 20, nozzle plate 30, resin film 40, and protective layer 50.

Figure 7:
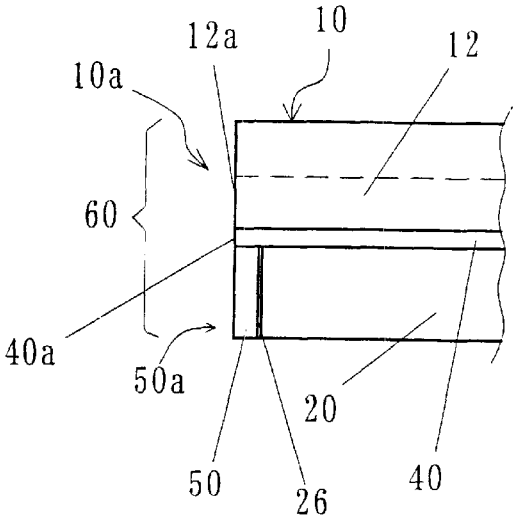
FIG. 7 is another side view for explaining the method of manufacturing the inkjet head shown in FIG. 1.

As shown in FIG. 7, the pressure-chamber plate 10, the resin film 40, and the protective layer 50 are aligned with each other at nozzle connection surface 60 which is a surface to which surface 30*a* of the nozzle plate 30 is connected. In other words, front surface 10*a* of the pressure-chamber plate 10, front surface 40*a* of the resin film 40, and front surface 50*a* of the protective layer 50 form the flat nozzle connection surface 60.

The pressure-chamber plate 10 has the desired number (four in FIG. 1 for description purposes) of pressure chambers 12 and ink introduction channels 14 and common ink chamber 16 in an approximately rectangular parallelepiped glass plate.

Each pressure chamber 12 receives and accommodates ink, and jets the ink from a corresponding nozzle hole 32 connected to opening 12 as the internal pressure increases. The internal pressure changes as the piezo-electric block 21 just under the pressure chamber 12 deforms, as described later. The pressure chamber 12 is formed as an approximately rectangular parallelepiped space by a concave groove on the pressure-chamber plate 10 and elastically deformable resin film 40.

The common ink chamber 16 supplies ink to each pressure chamber 12 through the corresponding ink introduction channel 14. A bottom of the common ink chamber 16 is defined by resin film 40 so as to absorb sudden internal-pressure changes, and connected to an ink supply device (not shown) at side 10*b* of the pressure-chamber plate 10. The common ink chamber 16 supplies a necessary amount of ink to the pressure chamber 12 via the ink introduction channel 14 when the chamber 12 returns to the original state after the pressure chamber 12 contracts, receives pressure, and jets ink.

The resin film 40 defines part of the pressure chambers 12, the common ink chamber 16, and the ink introduction channels 14. The resin film 40 serves to transmit deformation of each piezo-electric block 21 which will be described later to the corresponding pressure chamber 12, and to prevent ink in the pressure chambers 12 from penetrating into the grooves 23 in the piezo-electric element 20. The resin film 40 has a thickness of about 16 $\mu$m, for example. Although the resin film 40 is a member that forms one surface of the pressure chamber 12, it may be replaced with an elastic metal thin film.

The piezo-electric element 20 has a layered structure having a plurality of (four in FIG. 1 for description purposes) piezo-electric blocks which are divided by parallel grooves 23 which extend from front surface 20*a* to rear surface 20*b*. Internal electrodes 22 and 24 are provided between layers of piezo-electric elements 21. The internal electrodes 22 are connected to external electrode 26, and the internal electrodes are connected external electrode 28. FIG. 1 shows only one external electrode 28 for illustration purposes. The internal electrodes 22 and 24 are omitted in the drawings other than FIGS. 1 and 2 for illustration purposes.

As shown in FIG. 2, active area 25 is a portion where the internal electrodes 22 and 24 overlap each other in direction A, and each piezo-electric block deforms in the active area 25. The length of each active area 25 is adjustable depending upon pressure to be applied to the pressure chamber 12. The active area 25 is spaced from the nozzle connection surface 60 by a predetermined distance, and thus does not affect adhesion between the piezo-electric element 20 and the protective layer 50 at the nozzle connection surface 60.

The external electrode 26 is an electrode layer that is formed on an entire surface of the front surface 20*a* of the piezo-electric element 20 by a vacuum evaporation. The external electrode 26 is an electrode commonly used for all the piezo-electric blocks 21. The external electrode 26 is grounded. The external electrode 28 is provided on the rear surface 20*b* of the piezo-electric element 20, but is not formed on an entire surface of the rear surface 20*b*. It is independently formed on only a portion corresponding to each piezo-electric block 21. The external electrode 28 has the potential of zero unless electrified, but may apply positive voltage to the internal electrode 24 when electrified.

Due to such a structure, each piezo-electric block 21 of the piezo-electric element 20 does not deform when no voltage is applied to the external electrode 28, since both potentials of the internal electrodes 22 and 24 remain zero. On the other hand, when the voltage is applied from the external electrode 28, each piezo-electric block 21 may deform in the direction A (longitudinal direction) in FIG. 1, independent of the other piezo-electric blocks 21. In other words, the direction A is the polarization direction for the piezo-electric element 21. When the electrification to the external electrode 28 stops, that is, when the piezo-electric element 20 is discharged, the corresponding piezo-electric block 21 returns to the original state.

The protective layer 50 is a thermosetting epoxy adhesive member having an approximately rectangular parallelepiped shape with a thickness of about 50 $\mu$m, and connected via surface 50*b* to the front surface 20*a* of the piezo-electric element 20 (external electrode 26). However, the materials for the protective layer 50 are not limited to this type. Strictly speaking, the protective layer 50 in the practical inkjet head 100 does not have a strict rectangular parallelepiped shape, and the connection between the protective layer 50 and the piezo-electric element 20 is not clear by the external electrode 26 and the surface 50, as shown in FIGS. 1 and 2. The protective layer 50 partially penetrates into the grooves 23 in the piezo-electric element 20*b* before thermosetting. It is preferable that the protective layer 50 is made of insulating materials so as to prevent short-circuiting of the internal electrodes 22 and 24.

As described later, the protective layer 50 has various effects including the following effect resulted from the structure shown in FIG. 2.

First of all, the protective layer 50 spaces the piezo-electric element 20 from the nozzle connection surface 60 by about 50 $\mu$m. When ink leaks from the pressure chamber 12 and penetrates into the piezo-electric element 20, ink penetrates into the piezo-electric element 20 mainly through nozzle connection surface 60. However, the protective layer 50 spaces from the nozzle connection surface 60 the piezo-electric element which has been conventionally located at the nozzle connection surface 60, and prevents the ink from penetrating into the piezo-electric element 20 and short-circuiting the internal electrode 22 and 24. Since this effect comes from an arrangement of the piezo-electric element, the same effect is available in the conventional inkjet head if the piezo-electric element is spaced from the nozzle connection surface.

Next, the protective layer 50 shields the grooves 23. When ink leaks and penetrates into the piezo-electric element 20, the ink penetrates into the piezo-electric element 20 mainly from the grooves 23 through the nozzle connection surface 60 from the opening 12*a* of the pressure chamber 12. Since the protective layer 50 shields the grooves 23 from the nozzle connection surface 60, preventing ink from penetrating into the grooves 23 from the neighborhood of the front surface 20*a* of the piezo-electric element 20 and short-circuiting the internal electrodes 22 and 24.

The protective layer 50 is adhered to the piezo-electric element 20, raising the strength of the piezo-electric element 20. The piezo-electric element 20 has a layered structure, and each piezo-electric block essentially suffers from breaking easily, such as exfoliation, crack, and chip-off. The protective layer 50 with a thickness of 50 $\mu$m is adhered to the front surface 20*a* of the piezo-electric element 20 (external electrode 26), raising the strength of the piezo-electric element 20 and improving durability.

Thus, when the protective layer 50 is regarded as a reinforcing member, the protective layer 50 may be provided at another surface of the piezo-electric element 20, such as the rear surface 20*b*, in order to raise the strength of the piezo-electric element 20. In that case, the protective layer 50 may cover both or either of a portion where the external electrode 28 is located and a portion where the external electrode 28 is not located.

The protective layer 50 is adhered at its entire surface of the front surface 50*a* to the nozzle plate 30, and provides more stable adhesion than the conventional inkjet heads in which the piezo-electric element 20 is directly adhered to the nozzle plate 30, since the grooves 23 do not reduce the adhesion area according to the present invention.

Figure 5:
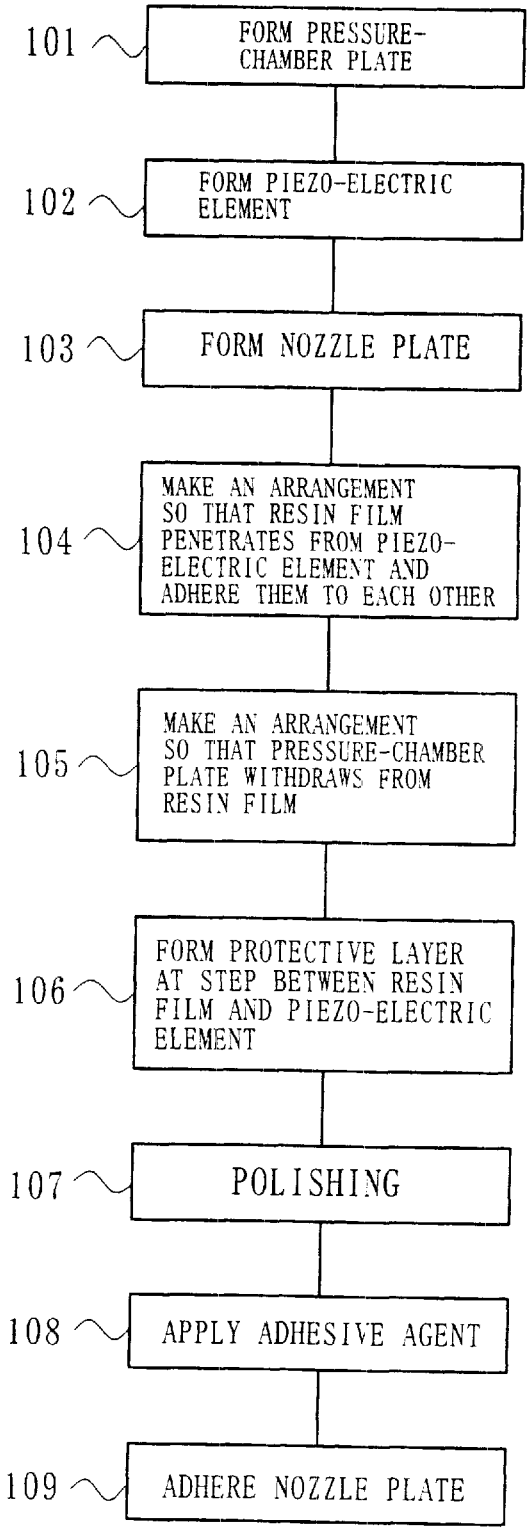
FIG. 5 is a flowchart which shows the method of manufacturing the inkjet head shown in FIG. 1.

Next follows a method of manufacturing inkjet head 100 of the present invention with reference to FIG. 5.

First, the pressure-chamber plate 10 is formed by processing a glass plate and forming the pressure chambers 12 and other elements (step 101).

Then, the piezo-electric element 20 is formed (step 102). This step may be conducted prior to or simultaneous with the step 101.

The piezo-electric element 20 of this embodiment is made of a plurality of green sheets 27. Each green sheets 27 is blended with the ceramic powder solvent, kneaded into paste, and then formed to be a thin film having a thickness of about 50 $\mu$m by a doctor blade.

Among these green sheets. a pattern of the internal electrode 22 is printed and formed onto one surface of each of the three green sheets, the internal electrode 24 is printed and formed onto one surface of each of other three green sheets, and no internal electrode is formed onto the remaining sheets. Each of the internal electrodes 22 and 24 is printed by blending alloy powder of silver and palladium with a solvent, forming a paste, and applying the paste as the pattern formation.

Then, the three sheets including the internal electrode 22 and the three sheets including the internal electrode 24 are alternately stuck together. The remaining six sheets are then stuck together also. Thereby, the layered structure of the piezo-electric element 20 is formed as shown in FIG. 2. In the piezo-electric element 20, the green sheets which include none of the internal electrodes 22 and 24 are formed as a base part.

These layered green sheets are sintered. Then, at least first six green sheets are partially cut by a diamond cutter from the front surface 20*a* to the rear surface 20*b*, whereby a plurality of piezo-electric blocks 21 are formed and divided by the grooves 23. Lastly, the external electrodes 26 and 28 are formed by the vacuum evaporation at the front surface 20*a* and the rear surface 20*b*. It is possible to form the grooves 23 before sintering.

Characteristics of the completed piezo-electric element 20 are inspected by applying voltage to the external electrodes 26 and 28, and poorly operating ones are eliminated.

Then, the nozzle plate 30 is formed by metal, such as stainless (step 103). Each nozzle hole 32 is processed into a conical shape (sectionally taper shape) which preferably spreads from the front surface 30*b* to the rear surface 30*a* in the nozzle plate 30. One of the reasons why the pressure-chamber plate 10 and the nozzle plate 30 are not formed as one member but the pressure-chamber plate 10 is adhered to the nozzle plate 30 is to obtain such conical nozzle hole 32. In this embodiment, the size of the nozzle hole 32 at the rear surface 30*a* is about 80 $\mu$m, the size of the nozzle hole 32 at the front surface 30*b* is about 25 to 35 $\mu$m. This step 103 may be conducted prior to or simultaneous with the steps 101 and/or 102.

Figure 3:
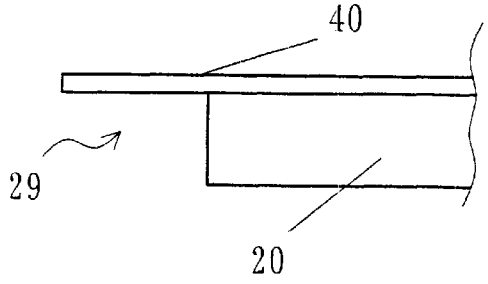
FIG. 3 is a side view for explaining a method of manufacturing the inkjet head shown in FIG. 1.

As shown in FIG. 3, the arrangement of the resin film 40 and the piezo-electric element 20 is determined so that the resin film 40 protrudes by about 500 $\mu$m toward the nozzle plate 30 from the piezo-electric element 20 that has been confirmed to work properly. Then, they are adhered to each other (step 104). Such an arrangement forms step 29 onto which the protective layer 50 is to be applied in order to protect the it piezo-electric element 20.

Figure 4:
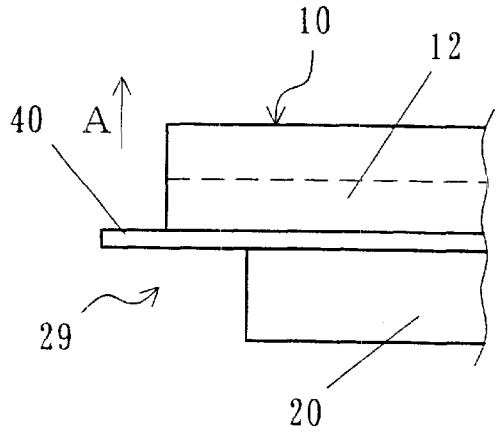
FIG. 4 is another side view for explaining the method of manufacturing the inkjet head shown in FIG. 1.

As shown in FIG. 4, the pressure-chamber plate 10 is arranged and adhered at the side opposite to the piezo-electric element 20 so that the pressure-chamber plate 10 withdraws by about 300 $\mu$m toward the nozzle plate 30 from the resin film 40, and protrudes by about 200 $\mu$m toward the nozzle plate 30 from the piezo-electric element 20 (step 105). Before the pressure-chamber plate 10 is adhered to the resin film 40, a positioning is conducted so that each piezo-electric block 21 corresponds to the pressure chamber 12.

This embodiment conducts the adhesion of the piezo-electric element 20 to the resin film 40 prior to the adhesion of the resin film 40 to the pressure-chamber plate 10. However, it is understood that the present invention includes a case where the step 105 is conducted prior to the step 104.

In this embodiment, the pressure-chamber plate 10 is arranged so that the pressure-chamber plate 10 withdraws from the resin film 40 toward the nozzle plate 30. This is to prevent the protective layer 50 from penetrating into the pressure chamber 12 from the opening 12*a* and close the opening 12*a* of the pressure chamber 12, which will be described later. Alternatively, the present invention may prevent the protective layer 50 from penetrating into the pressure chamber 12 by arranging a proper mask over the pressure-chamber plate 10 which protrudes from the resin film 40 (in articular, a surface opposite to the resin film 40), before the protective layer 50 is applied. In this case, a protrusion of the pressure-chamber plate 10 from the resin film 40 toward the nozzle 30 does not pose a problem.

The pressure-chamber plate 10 is arranged so that the pressure-chamber plate 10 protrudes from the piezo-electric element 20 toward the nozzle plate 30. This is to prevent the piezo-electric element 20 from being polished in the following polishing step.

In an attempt to prepare a three-layer structure shown in FIG. 4 composed of the pressure-chamber plate 10, the resin film 40, and the piezo-electric element 20, the preparation becomes easier if the direction A is orientated to the gravity direction. The resin film 40 protrudes in the three-layer structure in FIG. 4, and seemingly tends to bend toward the pressure-chamber plate 10 by the gravity action. However, the three-layer structure shown in FIG. 4 can be maintained by using the surface tension of the resin film 40. It is not an absolute requirement that the gravity direction necessarily accords with the direction A.

Figure 6:
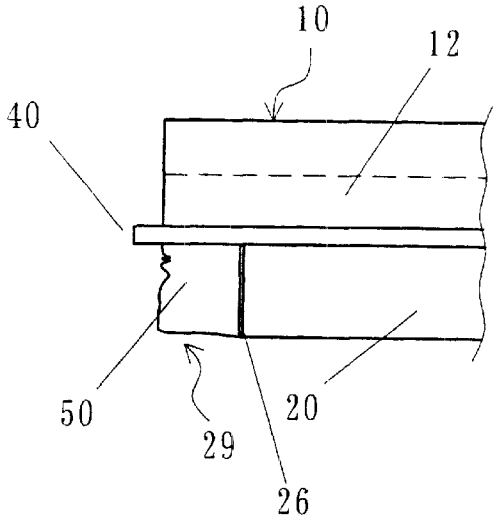
FIG. 6 is another side view for explaining the method of manufacturing the inkjet head shown in FIG. 1.

Next, as shown in FIG. 6, the protective layer 50 is formed onto the step 29 between the resin film 40 and the piezo-electric element 20 (step 106). Since this embodiment uses thermosetting epoxy adhesive agent for the protective later 50, the protective layer is thermally hardened after the protective layer 50 is applied. Since the protective layer 50 has a relatively low viscosity, it partially penetrates into the piezo-electric element 20 from the grooves 23 when applied to the step 29. After thermally hardened, the protective layer 50 hardens while sealing part of the grooves 23. It is possible to exchange the step 105 with the step 106, whereby the protective layer 50 is applied first and then the pressure-chamber plate 10 is adhered.

Unlike this embodiment which applies the protective layer 50 throughout the front surface 20*a* of the piezo-electric element 20 (external electrode 26), the protective layer 50 may be partially applied if necessity arises.

Next, flat nozzle connection surface 60 is formed by polishing the edge of the pressure-chamber plate 10, the resin film 40, and the protective layer 50 (step 107). FIG. 7 shows the nozzle connection surface 60 after the polishing.

This polishing process is required to precisely connect each nozzle hole 32 of the nozzle plate 30 to the pressure chamber 12 and firmly secure the nozzle plate 30 onto the pressure-chamber plate 10 and other elements. The polishing is conducted so that the thickness of about 50 $\mu$m remains for the protective layer 50. In other words, the pressure-chamber plate 10 is cut off by 150 $\mu$m.

In this polishing process, the piezo-electric element 20 is protected by the protective layer 50 and thus not affected by the polishing. Therefore, the polishing process does not cause any exfoliation, crack, and chip-off of the piezo-electric element 20. The external electrode 26 is never cut off. In addition, the pressure-chamber plate 10 is made of glass and is a relatively strong, enabling a high polishing speed. Thus, the manufacturing method of the present invention shortens the polishing time down to about one-fifth in comparison with the conventional manufacturing method.

When the polishing ends, the adhesive agent is applied onto the nozzle connection surface 60 by about 3 to 4 $\mu$m (step 108), whereby the nozzle plate 30 is adhered to the nozzle connection surface 60 so that the nozzle holes 32 correspond to the pressure chambers 12 (step 109).

According to the inkjet head of the present invention, the applied protective layer 50 exhibits several effects in the manufacturing process.

First, the protective layer 50 protects the piezo-electric element 20 which has a layered structure and easily suffers from exfoliation, from being polished and broken in the polishing process in the step 107.

Next, the protective layer 50 enables the polishing speed to be set for the pressure-chamber plate 10 which has a relatively high strength, shortening the polishing process time in comparison with the conventional manufacturing method.

In addition, the protective layer 50 penetrates into the grooves 23 of the piezo-electric element 20 by 20 to 30 $\mu$m and seals them, preventing ink from penetrating into the piezo-electric element 20 from the pressure chamber 12 through the nozzle connection surface 60 shown in FIG. 7 and the internal electrodes 22 and 24 from being short-circuiting. When such a sealing function of the protective layer 50 is to be emphasized, the protective layer 50 may be made of epoxy filling agent, acrylic and/or polyethylene resins. These sealing members (insulating materials) may be filled up by a desired amount in the grooves 23 when the piezo-electric element 20 is formed, raising the sealing function.

The protective layer 50 may save an inconvenient reconstruction of the external electrode 26 by protecting the external electrode 26 from being polished. In the conventional manufacturing method which does not use the protective layer 50, this external electrode is indispensable for the inspection of characteristics of the piezo-electric element 2, but cut off by the polishing. Therefore, a reconstruction of the external electrode has been required. The protective layer 50 according to the present invention eliminates this reconstruction process of the external electrode, shortening the manufacturing time.

When the inkjet head 100 is completed in this way, ink is then filled up in the pressure chamber 12. The filling of the ink is made by compressing ink from the common ink chamber 16 to the pressure chamber 12 or applying negative pressure to the nozzle holes 32 using a cap (not shown) which has been attached to the nozzle plate 30, so as to move ink from the common ink chamber 16 to the pressure chamber 12. In any event, the protective layer 50 prevents ink from penetrating into the grooves 23 in the piezo-electric element 20 through the nozzle connection surface 60 at the time of filling of it.

In the completed inkjet head 100, each external electrode 28 independently applies voltage to the internal electrode 24 of the piezo-electric block 21, and each piezo-electric block 21 independently deforms in the direction A in FIG. 1, bending the resin film 40 in the direction A and compressing corresponding pressure chamber 12. This compression results in jetting ink from the pressure chamber 12 through corresponding nozzle hole 32. When electrification from the external electrode 28 stops, the resin film 40 and the piezo-electric block 21 return to the original states by discharging. At that time, the internal pressure of the pressure chamber 12 reduces and ink is supplied from the common ink chamber 16 to the pressure chamber 12 through the ink introduction channel 14.

Although this embodiment uses the piezo-electric element 20 that deforms in the longitudinal direction, but may use one that deforms in the lateral direction.

Figure 8:
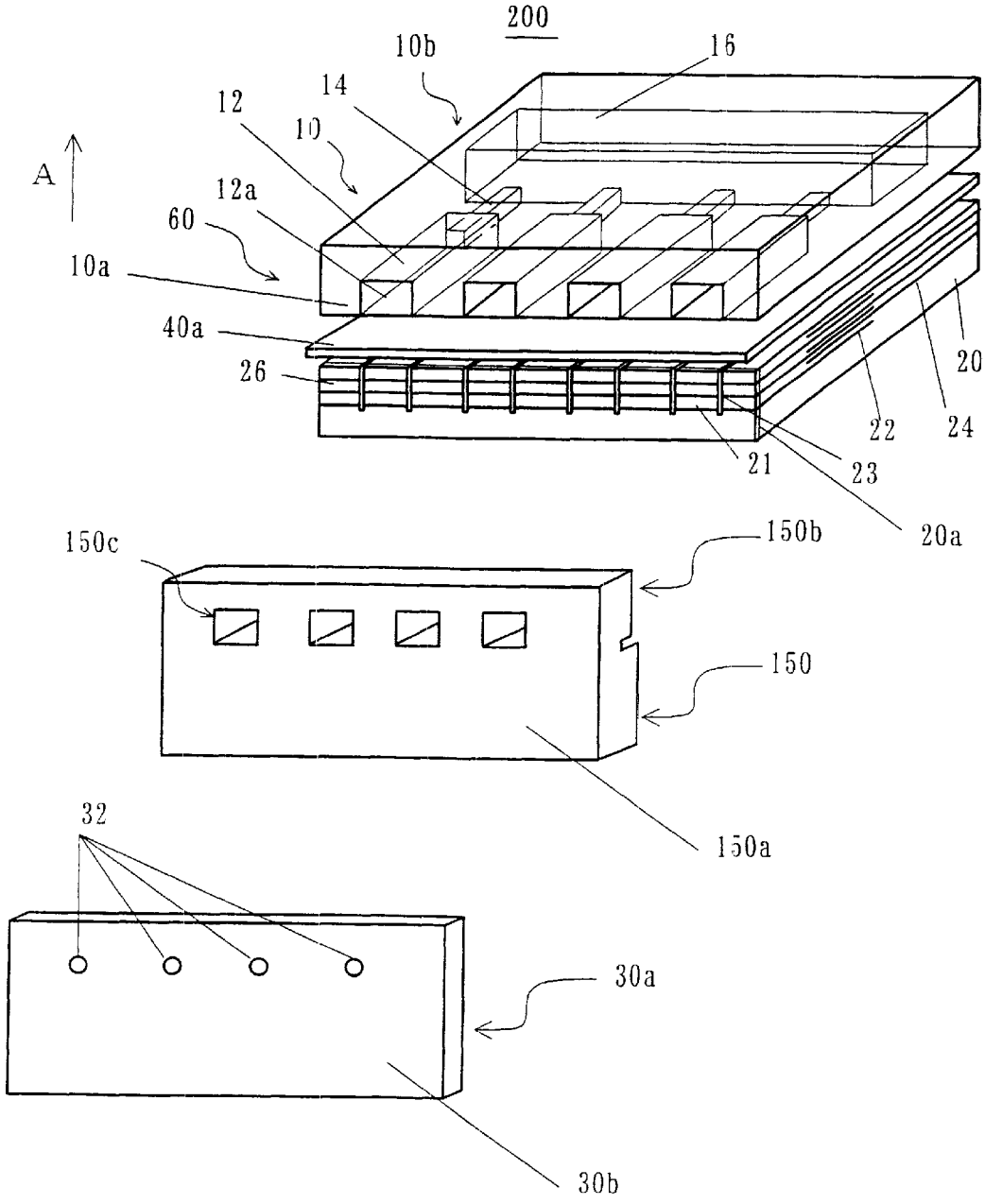
FIG. 8 is an exploded perspective view of an inkjet head of a second embodiment according to the present invention.

A description will now be given of inkjet head 200 of a second embodiment according to the present invention, with reference to the accompanying drawings. FIG. 8 is an exploded perspective view of the completed inkjet head 200. Those elements in FIG. 8 which are the same elements in FIG. 1 are designated by the same reference numerals, and a duplicate description will be omitted. The pressure-chamber plate 10 and resin film 40 in FIG. 8 are not polished in the polishing process (step 203) which will be described later, and have different in size from those in FIG. 1, but other that that they are the same and designated by the same reference numerals.

The inkjet head 200 includes the three-layer structure including the pressure chamber plate 10, the resin film 40, and the piezo-electric element 20, protective layer 150 which are formed at a front surface of the three-layer structure, and nozzle plate 30 which are attached to front surface 150*a* of the protective layer 150.

The three-layer structure is the same as that of inkjet head 100, but the front surface 10*a* of the pressure-chamber plate 10, the front surface 40 of the resin film 40, and the front surface 20*a* of the piezo-electric element 20 are not aligned with each other, and may have steps. On the other hand, all the steps are removed and made smooth by the polishing process in the conventional inkjet head, and the step between the pressure-chamber plate 10 and the resin film 40 is removed by the polishing process in the step 107 in the inkjet head 100.

The protective layer 150 is made of materials similar to those of the protective layer 50 (for example, a thermosetting epoxy adhesive member), and includes front surface 150*a* which serves as a nozzle connection surface, rear surface 150*b* which is connected to the three-layer structure, and openings 150*c* which correspond to the pressure chambers 12. The thickness of the protective layer 150 depends upon an allowable order the steps among the surfaces 10*a*, 40*a*, and 20*a* in the three-layer structure.

The nozzle connection surface 150*a* is made flat and attached to the nozzle plate 30. Similar to the protective layer 50, a connection between the protective layer 150 and the three-layer structure (in particular, piezo-electric element 20) is not clear in the actual inkjet head 200. Part of the protective layer 150 penetrates into the grooves 23 of the piezo-electric element 20. Each opening 150*c* of the protective layer 150 has the same size as that of each opening 12*a* of the pressure chamber 12. Therefore, the protective layer 150 does not obstruct jetting of ink from the pressure chamber 12 through the nozzle hole 32.

In this way, according to the inkjet head 200 of this embodiment, only the surface 150*a* of the protective layer 150 provides a smooth nozzle connection surface. It is not necessary to smooth steps among the surfaces 10*a*, 40*a*, and 20*a* of the three-layer structure.

Figure 9:
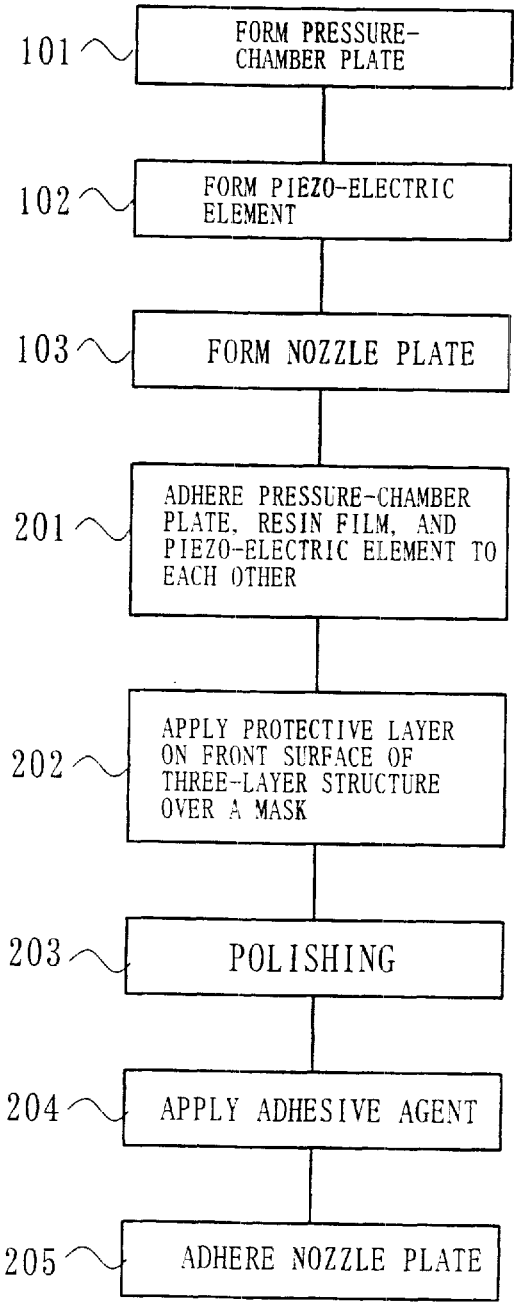
FIG. 9 is a flowchart which shows the method of manufacturing the inkjet head shown in FIG. 8.

A description will now be give of a method of manufacturing the inkjet head 200 of the present invention with reference to FIG. 9.

A description will be omitted of those steps of forming the pressure-chamber plate 10 (step 101), forming the piezo-electric element 20 (step 102), and forming the nozzle plate 30 (step 103), since these steps are similar to those in FIG. 5.

Then, a three-layer structure is formed by adhering the pressure-chamber plate 10, the resin film 40, and the piezo-electric element 20 so that the steps formed by the surfaces 10*a*, 40*a*, and 20*a* are below the predetermined order (e.g., within 10 $\mu$m) (step 201). Only if these steps are within the predetermined order, which member protrudes or withdraws among the three-layer structure is not the matter. The order of adhesions among the pressure-chamber plate 10, the resin film 40, and the piezo-electric element 20 may be arbitrarily selected if piezo-electric elements 21 correspond to the pressure chamber 12.

Next, a mask is formed which opens a portion corresponding to the openings 12*a* of the pressure-chamber 12. Through this mask, the protective layer 150 is applied on the surfaces 10*a*, 40*a* and 20*a* of the three-layer structure (step 202). The mask is easily formed by the known mask patterning technology. When the steps in the three-layer structure is 100 $\mu$m, the protective layer may be applied with a thickness of about 200 $\mu$m to 300 $\mu$m.

Thereafter, the front surface of the protective layer 150 is polished and made to be the smooth nozzle connection surface 150*a* (step 203). The adhesive agent is applied on the surface 150*a* (step 204), and the nozzle plate 30 is adhered to the nozzle connection surface 150*a* (step 205).

In this way, according to the method of manufacturing the inkjet head 200, it is unnecessary to precisely position the pressure-chamber plate 10, the resin film 40, and the piezo-electric element 20 in a direction toward the nozzle plate 30, shortening the manufacturing time. The inkjet head 100 requires, as shown in FIGS. 3 and 4, the pressure-chamber plate 10, the resin film 40, and the piezo-electric element 20 to be connected in a predetermined arrangement, but the protective layer 150 absorbs the steps among these three members. Only if these three members are aligned within a predetermined order, any shape of the step may be acceptable. Therefore, an edge of the three-layer structure may be concave where the pressure-chamber plate 10 and the piezo-electric element 20 sectionally protrude from the resin film 40, or convex where the resin film 40 sectionally protrudes from them.

Ink is filled up in the completed inkjet head 200 by a method similar to that of the inkjet head 100, and the inkjet head 200 operates similar to the inkjet head 100. Therefore, a description thereof will be omitted.

The present invention is not limited to those inkjet heads in which the piezo-electric block 21 is installed outside the pressure chamber 12, but is applicable to other inkjet heads which adhere a nozzle plate, for example, those inkjet heads which have a piezo-electric element that includes a pressure chamber.

Figure 10:
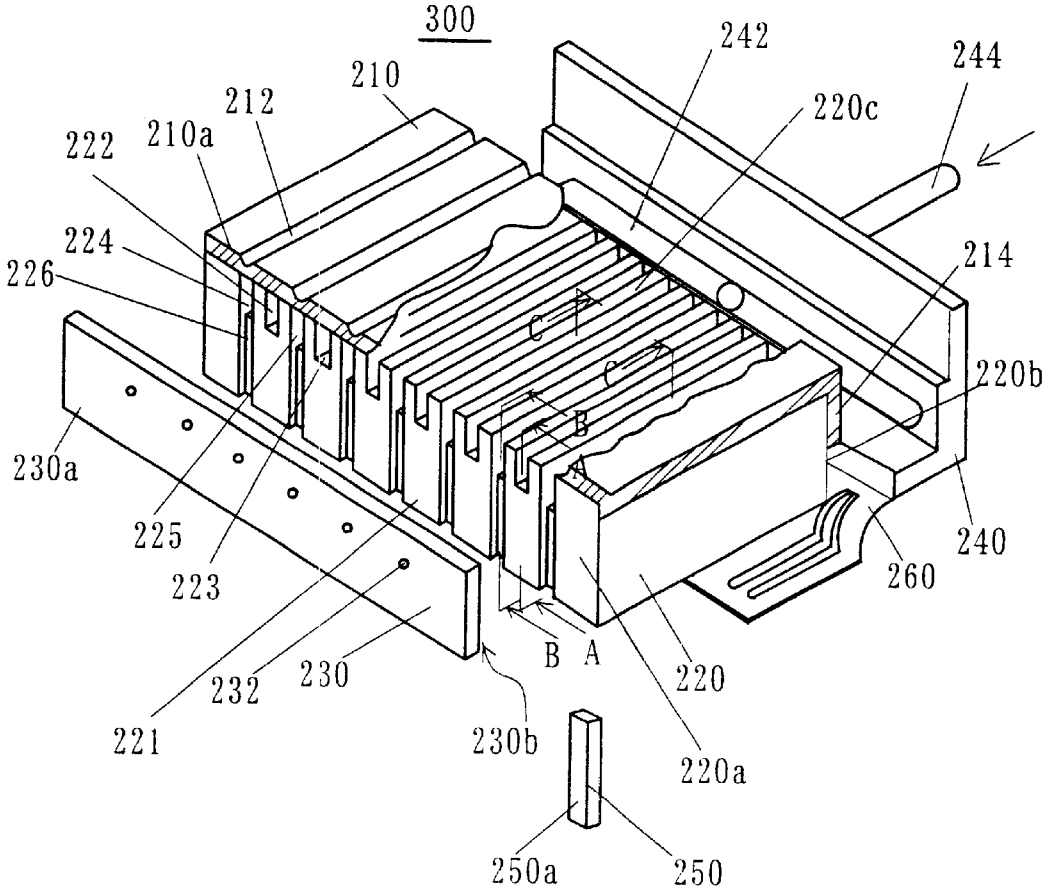
FIG. 10 is an exploded perspective view of an inkjet head of a third embodiment according to the present invention.

Referring to FIGS. 10 through 16, a description will now be given of the inkjet head of the present invention having a piezo-electric element which includes such a built-in pressure chamber. FIG. 10 is an overall structural view of inkjet head 300 according to the present invention.

The inkjet head 300 includes, as shown in FIG. 10, upper lid 210, piezo-electric element 220, nozzle plate 230, ink supply metal fitting 240, protective layers 250, and flexible printed board 260. The protective layers 250 are provided onto perpendicular grooves 226 in the piezo-electric element 220 which will be described later. The number of protective layers 250 corresponds to the number of the perpendicular grooves 226 (seven in FIG. 10), but one of the protective layers 250 is picked up and slightly enlarged in FIG. 10 for illustration purposes.

The upper lid 210 is attached to the upper surface 220*c* of the piezo-electric element 220, and has horizontal grooves 212 corresponding to horizontal grooves 224 of the piezo-electric element 220, and bending portion 214 at the side of the ink supply metal fitting 240. The front surface 210*a* constitutes part of the nozzle connection surface 270 to which the nozzle plate 230 is attached.

Figure 12:
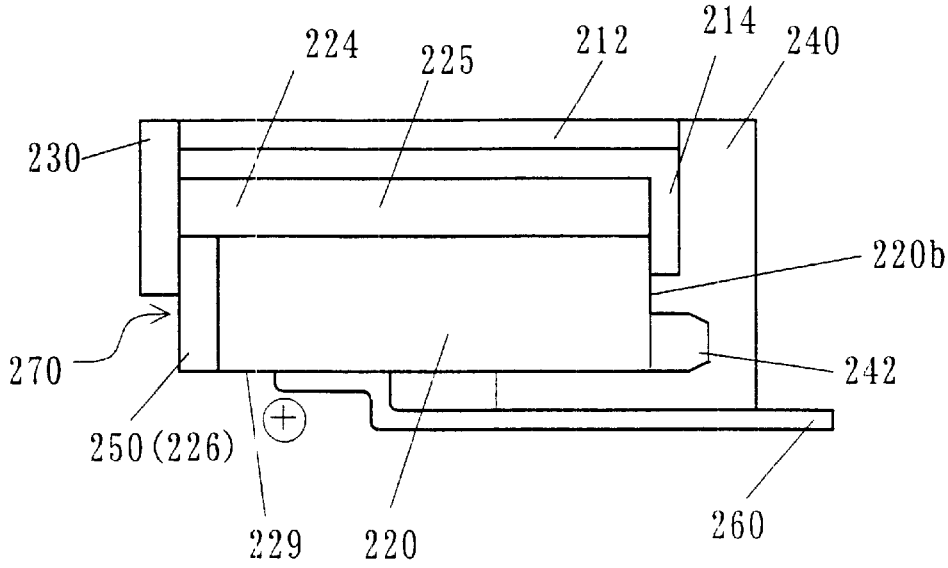
FIG. 12 is a sectional view of the inkjet head taken along line B—B in FIG. 10.
Figure 13:
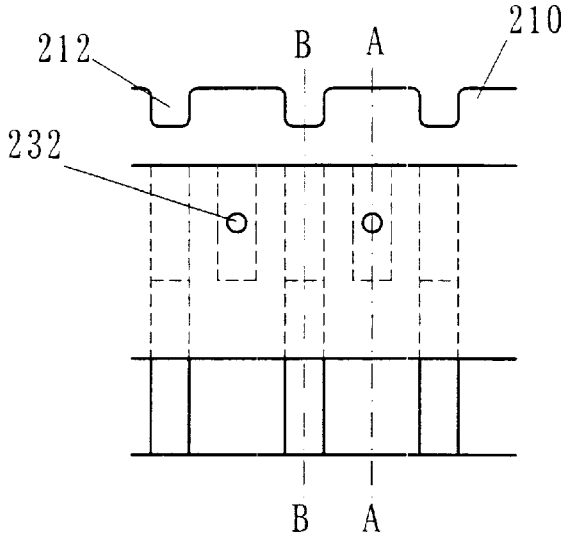
FIG. 13 is a sectional view of the inkjet head taken along line C—C in FIG. 10.

As shown in FIG. 13, the upper lid 210 is thin in thickness at the horizontal grooves 212. This structure absorbs any distortion of portion 221*a* of piezo-electric block 221 which is adjacent to this piezo-electric element 221 when portion 221*a* which constitutes a wall of pressure chamber 222 in another piezo-electric block 221 shown in FIG. 15 deforms as described later. The bending portion 214 is connected to the rear surface 220*b* of the piezo-electric element 220, as shown in FIG. 12.

The piezo-electric element 220 includes a plurality of piezo-electric blocks 221, and each piezo-electric block 221 has pressure chamber 222. Two adjacent piezo-electric blocks 221 are divided by the horizontal groove 224 and the perpendicular groove 226. The pressure chambers 222 and the horizontal grooves 224 extend parallel from the front surface 220*a* to the rear surface 220*b* of the piezo-electric element 220. With the front surface 250*a* of each protective layer 250, the front surface 220*a* constitutes the nozzle connection surface 270 to which the nozzle plate 230 is attached as described later.

As shown in FIG. 10, the perpendicular groove 226 are connected to the horizontal grooves 224 at the side of front surface 220*a* of the piezo-electric element 220. The perpendicular groove 226 receives each protective layer 250, as described later.

Figure 11:
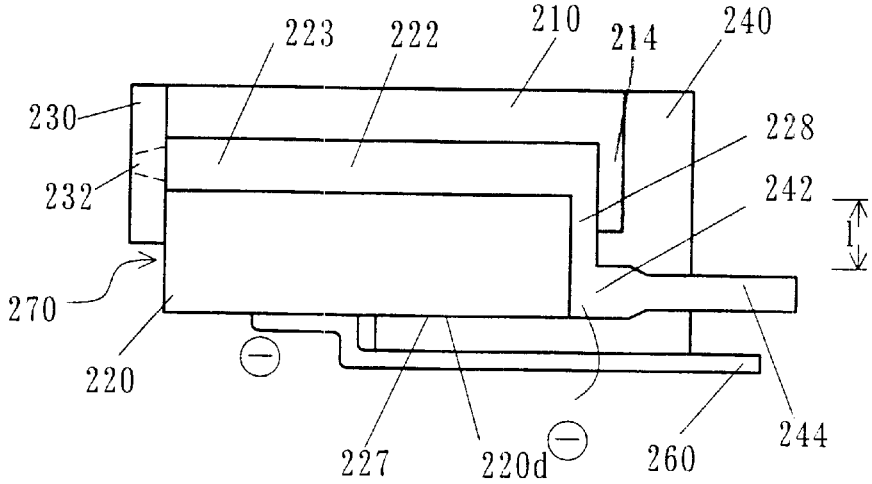
FIG. 11 is a sectional view of the inkjet head taken along line A—A in FIG. 10.
Figure 14:
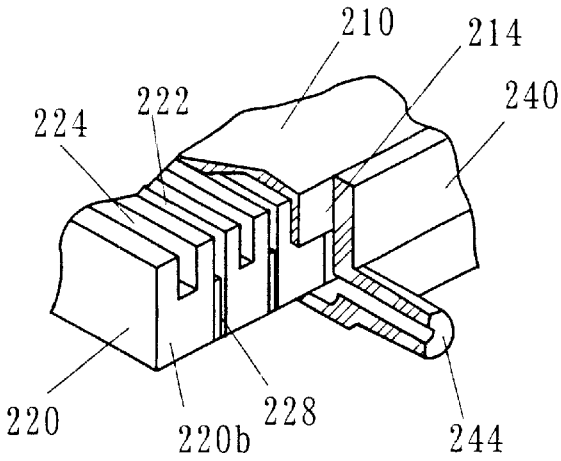
FIG. 14 is a partial perspective view of the inkjet head viewed from a side of an ink supply channel in FIG. 10.

The pressure chambers 222 are connected to the perpendicular grooves 228 at the side of the rear surface 220*b* of the piezo-electric element 220, as shown in FIG. 14. As shown in FIG. 11, length "l" of the perpendicular groove 228 serves to throttle the pressure chamber 222. The section, width, depth, and the length "l" of the perpendicular groove 228 are determined so as to obtain a proper throttling effect.

Figure 15:
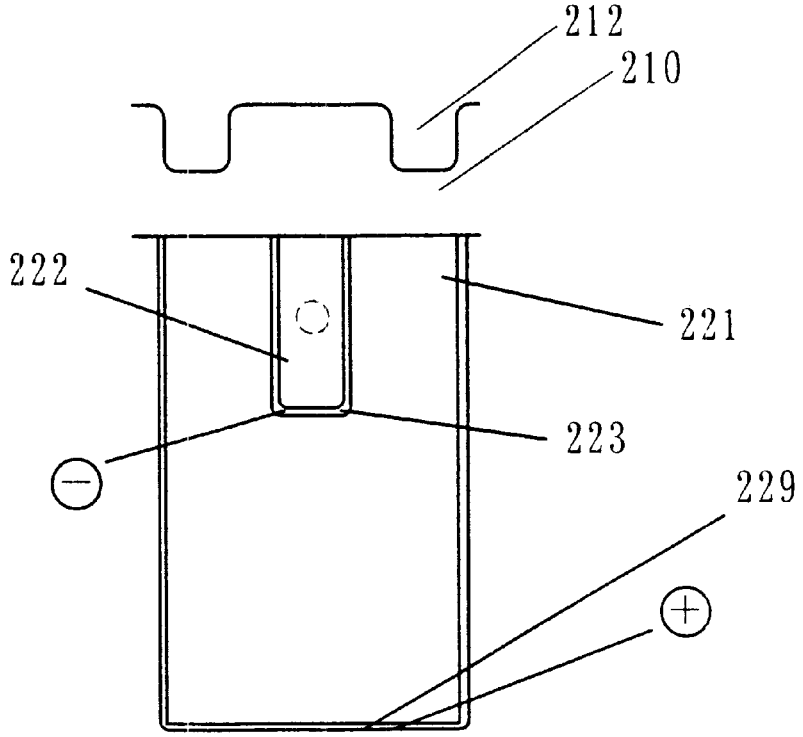
FIG. 15 is a sectional view of an electrode configuration of the inkjet head shown in FIG. 10.

There is provided internal electrode 223 as an negative electrode in an inner surface of each pressure chamber 222 and corresponding perpendicular groove 228. Each internal electrode 223 is connected, as shown in FIGS. 11 and 15, to the external electrode 227 in an area near the rear surface 220*b* of the bottom surface 220*d* of the piezo-electric element 220. Therefore, each external electrode 227 may independently apply negative voltage to the corresponding piezo-electric block 221.

There is provided internal electrode 225 as a positive electrode in each horizontal groove 224 and corresponding perpendicular groove 226. All the internal electrodes 225 are connected, as shown in FIGS. 12 and 15, to the common external electrode 229.

Moreover, as shown in FIGS. 11 and 12, the external electrodes 227 and 229 are drawn out from the side of the rear surface of 220*b* and the front surface 220*a* of the piezo-electric element 220, and connected to a predetermined lead pattern of the flexible printed board 260. Therefore, desired piezo-electric element(s) 221 may be activated by applying voltage to the external electrode 227 through the flexible printed board 260.

The internal electrodes 223 and 225 are formed as a pattern by etching after the entire surface of the piezo-electric element 220 including the grooves are plated to form a metal layer, and the front surface 220*a*, the rear surface 220*b*, and the top surface 220*c* are cut to remove the metal layer.

The nozzle plate 230 has nozzle holes 232 corresponding to the pressure chambers 222, and is connected to the nozzle connection surface 270 which is constituted by the front surface 210*a* of the upper lid 210, the front surfaces 220*a* of the piezo-electric blocks 221, and the front surfaces 250*a* of the protective layer 250. Preferably, each nozzle hole 232 has a taper section from the front surface 230*a* to the rear surface 230*b* in the nozzle plate 230.

The ink supply metal fitting 240 is connected to the rear surface 220*b* of the piezo-electric element 220, and has common ink chamber 242. The common ink chamber 242 is connected, as shown in FIG. 11, to not only the perpendicular grooves 228 and the pressure chambers 222 in the piezo-electric element 220, but also the ink supply channel 244 which supplies ink.

Each protective layer 250 is located in the concave perpendicular groove 226 in the piezo-electric element 220. The number of protective layers 250 corresponds to the number of perpendicular grooves 226 (seven in FIG. 10). The protective layer 250 covers the internal electrode 225 formed on the perpendicular groove 226, and prevents ink which has leaked from the pressure chamber 222 from short-circuiting the internal electrode 225 and internal electrode 223, which is formed at an inner surface of the pressure chamber 222 through the front surface 220*a* of the piezo-electric block 221. As discussed, the front surfaces 250*a* of the protective layers 250 form the nozzle connection surface 270 with the front surface 210*a* of the upper lid 210 and the front surface 220*a* of the piezo-electric element 220.

The protective layer 250 is formed, after the piezo-electric element 220 shown in FIG. 10 is formed, and before or after the upper lid 210 and the piezo-electric element 220 are adhered to each other, by covering the front surface 220*a* with a mask and then applying the silicon rubber adhesive agent to it. The mask may open portions corresponding to the perpendicular grooves 226. This embodiment uses silicon rubber adhesive agent having a high viscosity and prevents it from penetrating into the horizontal grooves 225. This is because the protective layer 250, if filled up in the horizontal grooves 225, may possibly prevent a smooth deformation of each piezo-electric block 221. Needless to say, the protective layer 250 is not limited to the silicon rubber adhesive agent, but is applicable to other insulating adhesive member having a high viscosity.

In operation of the inkjet head 300, the flexible printed board 260 applies voltage to the external electrode 227 corresponding to desired piezo-electric block 221. Then, a potential difference occurs at both sides of the portion 221*a* which constitutes a wall of the pressure chamber 222 in the piezo-electric block 221 shown in FIG. 15, and each portion 221 deforms to shrink the pressure chamber 222. Thereby, the pressure chamber 222 is compressed, ink in it is jet from the corresponding nozzle hole 232. The pressure wave in the pressure chamber 222 propagates not only to the front nozzle hole 232 but also to the rear surface. The pressure wave which propagates to the back is reflected by the bending part 214 of the upper lid 210, and returns to the front.

Fluid ink has a mass although it is a very small amount, and it takes a predetermined time to accelerate ink up to a speed that allows ejection from the nozzle hole 232. However, the pressure chamber 222 is bent in direction by right angle, and throttled in section, whereby the internal pressure of the pressure chamber 222 is sufficiently maintained up to a pressure necessary for the ejection.

As a result, while the perpendicular grooves 228 decrease a pressure loss in the pressure chamber 222, nozzle holes 232 jet ink from the pressure chamber 222 at a sufficient ejection speed.

When the voltage application from the external electrode 227 stops, the piezo-electric block 221 returns to the original state, and ink is supplied, through the perpendicular groove 228, from the common ink chamber 242 to the pressure chamber 222 having a negative pressure. In this case, the perpendicular groove 228 may give a necessary throttling effect by its shape of bend at a right angle without reducing its sectional area, maintaining small the channel resistance to ink inhalation from the common ink chamber 242 to the pressure chamber 222.

A formation of such an ink channel facilitates to process each component, such as upper lid 210, the nozzle plate 230, and the ink supply metal fittings 240, connect these components to the piezo-electric element 220, and provide an inkjet head having a good precision. In addition, this formation may increase a jetting speed and improve the printing quality.

There are various variations to the protective layer 250. Although the nozzle connection surface is comprised of three members, such as the upper lid 210, the protective layer 250, and the piezo-electric block 221 in the above embodiment, the nozzle may be formed by two members, such as the upper lid 210 and the protective layer. In this case, the protective layer 250 may be replaced with the protective layer 280 shown in FIG. 16 or the protective layer 290 shown in FIG. 17.

Figure 16:
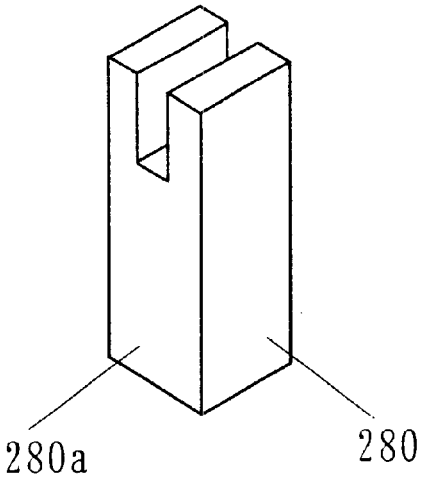
FIG. 16 is a partial perspective view of another example of a protective layer applicable to the inkjet head shown in FIG. 10.

The protective layer 280 shown in FIG. 16 has a shape identical to the sectional shape of each piezo-electric block 221, and is formed at the front surface 220*a* of each piezo-electric block 221. In this case, front surface 280*a* of each protective layer 280 and the front surface 210*a* of the upper lid 210 constitute the nozzle connection surface.

The protective layers 280 are formed, after the piezo-electric element shown in FIG. 22 is formed, for example, after the piezo-electric element 221 and the upper lid 210 are adhered to each other, by applying the silicon rubber adhesive agent over a mask which opens only the front surface 220*a* of each piezo-electric block 221. In this case, for example, an arrangement is determined so that the upper lid 210 corresponds to the resin film 40 shown in FIG. 3 and the piezo-electric element 220 corresponds to the piezo-electric element 20 shown in FIG. 3. Thereby, the upper lid 210 protrudes from the piezo-electric element 220 toward the nozzle plate 230 and then they are adhered to each other. The protective layer is formed by using a mask at a step between the upper lid 210 and the piezo-electric element 220. Then, the polishing is conducted and the smooth nozzle connection surface is formed.

The protective layer 280 has a function which does not exist in the protective layer 250. The piezo-electric element 220 is polished after the upper lid 210 is attached, and the protective layer 280 which has been attached to the front surface of the piezo-electric element 220 prevents the relatively fragile piezo-electric element 220 from being broken by the polishing.

Figure 17:
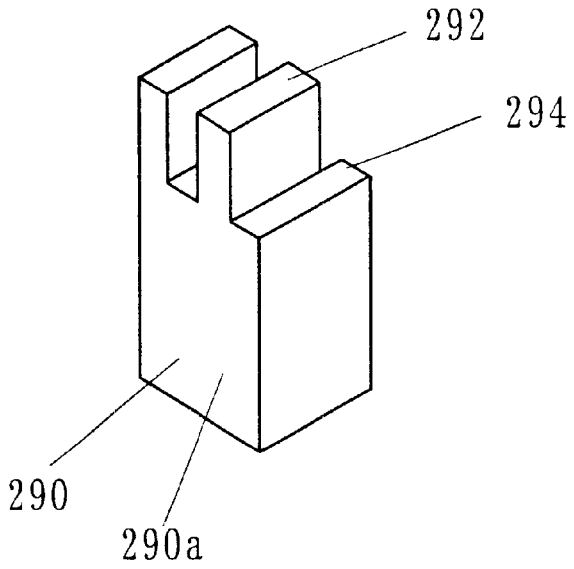
FIG. 17 is a partial perspective view of still another example of a protective layer applicable to the inkjet head shown in FIG. 10.

The protective layer 290 shown in FIG. 17 has a shape of a combination of the protective layers 250 and 280, and covers each piezo-electric element 221 and perpendicular groove 226. Portion 292 of the protective layer 290 is formed on the front surface 220*a* of each piezo-electric element 221, and portion 294 is formed on the perpendicular groove 226 adjacent to the piezo-electric element 221. Front surface 290*a* of each protective layer 290 forms nozzle connection surface, with the front surface 210*a* of the upper lid 210.

The protective layer 290 is formed, after the piezo-electric element 220 shown in FIG. 10 is formed, for example, after the upper lid 210 and the piezo-electric element 220 are adhered to each other, by applying the silicon rubber adhesive agent over a mask which closes the pressure chambers 222 and the horizontal grooves 224. Similar to the formation of the protective layer 280, an arrangement is determined so that the upper lid 210 protrudes from the piezo-electric element 220 toward the nozzle plate 230 and then they are adhered to each other. Then, the protective layer is formed at the step between the upper lid 210 and the piezo-electric element 220 by using the aforementioned mask. Then, the flat nozzle connection surface is formed by the polishing.

The protective layer 290 serves as both the protective layers 250 and 280. Therefore, the protective layer 290 prevents breaking of the piezo-electric element 220 and short-circuiting of the internal electrodes 223 and 225.

The protective layer 250 may be formed by the similar manner of forming the protective layer 290, in which the polished range is made deep, removing the protective layers on the piezo-electric blocks 221, and leaving the protective layer in the perpendicular grooves 226.

As a variation of the protective layer 250, the nozzle connection surface may be formed only the protective layer. In this case, the protective layer is formed not only on the piezo-electric element 220 but also onto the front surface 210*a* of the upper lid 210. As discussed, any one or part of the pattern shown in FIG. 10, 16 or 17 may be formed on the piezo-electric element 220, and combined with portion on the front surface 210*a* of the upper lid 210. A mask pattern which produces the protective layer may be formed by any known method.

The present invention is not limited to so-called piezo-electric inkjet heads, but is broadly applicable to inkjet heads in which a nozzle plate is attached.

The present invention is broadly applicable to those fluid pumps which polish the nozzle connection surface and those require fluid leakage at the nozzle connection surface.

Further, the present invention is not limited to the above embodiments, but various variations may be made without departing from the scope of the present invention.

As described above, according to the present invention, the protective layer protects the piezo-electric element from ink leakage and short-circuiting, providing a reliable inkjet heads exhibiting stable operations. In a method of manufacturing such an inkjet head, the protective layer may protect the piezo-electric element from being broken by the polishing and shorten the manufacturing time, whereby the present invention may provide a safe, fast and inexpensive inkjet-head manufacturing method.

Moreover, the present invention is not limited to inkjet heads that use a piezo-electric element, but is broadly applicable to fluid pumps in which a nozzle plate is adhered to a chamber that accommodates fluid. Such a fluid pump is protected by the protective layer, whereby an element located at and/or near the nozzle connection surface is not mechanically and electrically broken by the polishing process and/or is not required to be reconstructed after the polishing process, while damages of fluid leakage are minimized.

What is claimed is:

1. An inkjet head comprising:

a pressure-chamber plate which forms a pressure chamber for accommodating ink;

a piezo-electric element which may compress the pressure chamber in said pressure-chamber plate;

a protective layer, connected to said piezo-electric element, which protective layer forms at least part of a nozzle connection surface and spaces said piezo-electric element from the nozzle connection surface; and a nozzle plate having a nozzle hole which jets the ink in the pressure chamber when said piezo-electric element compresses the pressure chamber, said nozzle plate being connected to the nozzle connection surface.

2. An inkjet head according to claim 1, wherein said protective layer is made of organic resin.

3. An inkjet head according to claim 1, wherein said piezo-electric element has an external electrode which may compress the pressure chamber when electrified, said piezo-electric element being connected to said protective layer via the external electrode.

4. An inkjet head according to claim 1, wherein said protective layer spaces said pressure-chamber plate, in addition to said piezo-electric element, from the nozzle connection surface.

5. An inkjet head comprising:

a piezo-electric element which forms a pressure chamber for accommodating ink, and may compress the pressure chamber;

a protective layer, connected to said piezo-electric element, which protective layer forms at least part of a nozzle connection surface and spaces said piezo-electric element from the nozzle connection surface; and a nozzle plate having a nozzle hole which jets the ink in the pressure chamber when said piezo-electric element compresses the pressure chamber, said nozzle plate being connected to the nozzle connection surface.

6. An inkjet head comprising:

a piezo-electric element which forms a pressure chamber for accommodating ink, and may compress the pressure chamber, said piezo-electric element having first and second internal electrodes;

a protective layer, connected to said piezo-electric element, which protective layer shields the second internal electrode from the first internal electrode, and forms at least part of a nozzle connection surface; and a nozzle plate having a nozzle hole which jets the ink in the pressure chamber when the first and second internal electrodes are electrified and a potential difference occurs between the electrodes, enabling said piezo-electric element to compress the pressure chamber, said nozzle plate being connected to the nozzle connection surface.

7. An inkjet head comprising:

a pressure-chamber plate which forms a pressure chamber for accommodating ink, and forms at least part of a nozzle connection surface, a piezo-electric element, spaced from the nozzle connection surface, which may compress the pressure chamber in said pressure-chamber plate; and a nozzle plate having a nozzle hole which jets the ink in the pressure chamber perpendicular to a direction in which said piezo-electric element compresses the pressure chamber, said nozzle plate being connected to the nozzle connection surface, wherein said pressure-chamber plate forms a plurality of pressure chambers, said piezo-electric element being divided chambers by a plurality of grooves into a plurality of piezo-electric blocks corresponding to the pressure, and wherein the inkjet head further comprises a shield member which shields the grooves in said piezo-electric element from the nozzle connection surface.

8. An inkjet head comprising:

a pressure-chamber plate which forms a pressure chamber for accommodating ink, and forms at least part of a nozzle connection surface;

a piezo-electric element, spaced from the nozzle connection surface, which may compress the pressure chamber in said pressure-chamber plate; and a nozzle plate having a nozzle hole which jets the ink in the pressure chamber perpendicular to a direction in which said piezo-electric element compresses the pressure chamber, said nozzle plate being connected to the nozzle connection surface, wherein said pressure-chamber plate forms a plurality of pressure chambers, said piezo-electric element being divided by a plurality of grooves into a plurality of piezo-electric blocks, each piezo-electric block having an internal electrode and being able to independently compress one of the pressure chambers when the internal electrode is electrified; and wherein said inkjet head further comprises a seal member which seals the grooves in said piezo-electric element, and protects the internal electrodes in the piezo-electric blocks from short-circuiting.

9. An inkjet head comprising:

a pressure-chamber plate which forms a pressure chamber for accommodating ink, and forms at least part of a nozzle connection surface;

a piezo-electric element, spaced from the nozzle connection surface, which may compress the pressure chamber in said pressure-chamber plate;

a nozzle plate having a nozzle hole which jets the ink in the pressure chamber perpendicular to a direction in which said piezo-electric element compresses the pressure chamber, said nozzle plate being connected to the nozzle connection surface, and a reinforcing member which reinforces strength of said piezo-electric element.

10. A fluid pump comprising:

a first member which accommodates fluid;

a second member, connected to the first member, which ejects the fluid accommodated in the first member;

a protective layer, connected to the second member, which protective layer forms at least part of a nozzle connection surface and spaces the second member from the nozzle connection surface; and a nozzle plate having a nozzle hole which jets the fluid from the second member, said nozzle plate being connected to the nozzle connection plate.

* * * * *

UNITED STATES PATENT AND TRADEMARK OFFICE

CERTIFICATE OF CORRECTION

PATENT NO. : 6,450,623 B1
DATED : September 17, 2002
INVENTOR(S) : Watanabe et al.

It is certified that error appears in the above-identified patent and that said Letters Patent is hereby corrected as shown below:

Title page,
Item [75] Inventor change "Mitsuhiro Soneda" to be -- Hiromitsu Soneda --

Signed and Sealed this

Ninth Day of September, 2003

JAMES E. ROGAN
*Director of the United States Patent and Trademark Office*